US006725567B2

(12) United States Patent
Yano et al.

(10) Patent No.: US 6,725,567 B2
(45) Date of Patent: Apr. 27, 2004

(54) METHOD OF DRYING HONEYCOMB STRUCTURAL BODIES

(75) Inventors: Masashi Yano, Nagoya (JP); Kenichi Tanaka, Nagoya (JP)

(73) Assignee: NGK Insulators, Ltd. (JP)

( * ) Notice: Subject to any disclaimer, the term of this patent is extended or adjusted under 35 U.S.C. 154(b) by 0 days.

(21) Appl. No.: 10/060,294

(22) Filed: Feb. 1, 2002

(65) Prior Publication Data

US 2002/0112364 A1 Aug. 22, 2002

(30) Foreign Application Priority Data

Feb. 2, 2001 (JP) ..... 2001-026894

(51) Int. Cl.[7] ..... F26B 3/06

(52) U.S. Cl. ..... 34/419; 34/255; 34/259; 34/307; 34/311; 34/437

(58) Field of Search ..... 34/419, 418, 420, 34/218, 255, 259, 265, 307, 309, 311, 437; 219/764, 770, 780, 78.11

(56) References Cited

U.S. PATENT DOCUMENTS

| | | | | | |
|---|---|---|---|---|---|
| 2,740,756 | A | | 4/1956 | Thomas | 204/180 |
| 4,103,431 | A | | 8/1978 | Levinson | 34/4 |
| 4,439,929 | A | * | 4/1984 | Kitagawa et al. | 34/1 |
| 4,837,943 | A | * | 6/1989 | Mizutani | 34/1 |
| 4,866,857 | A | * | 9/1989 | Clasen | 34/10 |
| 5,265,346 | A | * | 11/1993 | Jikumaru et al. | 34/1 |
| 5,388,345 | A | * | 2/1995 | Brundage et al. | 34/256 |
| 5,406,058 | A | * | 4/1995 | Lipp | 219/774 |
| 5,946,817 | A | * | 9/1999 | Sato | 37/267 |
| 6,506,336 | B1 | * | 1/2003 | Beall et al. | 264/636 |
| 6,539,644 | B1 | * | 4/2003 | Araya | 34/259 |

FOREIGN PATENT DOCUMENTS

| | | |
|---|---|---|
| DE | 36 23 511 A1 | 1/1988 |
| EP | 0 273 707 | 7/1988 |
| JP | 3-275310 | 12/1991 |

* cited by examiner

*Primary Examiner*—Henry Bennett
*Assistant Examiner*—Camtu Nguyen
(74) *Attorney, Agent, or Firm*—Parkhurst & Wendel, L.L.P.

(57) ABSTRACT

A method of drying honeycomb structural bodies in which a dielectric drying is performed by moving the honeycomb structural bodies in a dielectric drying apparatus under a condition such that vapor is flowed in the dielectric drying apparatus, includes the steps of: covering a surrounding area of the honeycomb structural body by a sheet with a constant space; and performing the dielectric drying under such a condition.

8 Claims, 1 Drawing Sheet

METHOD OF DRYING HONEYCOMB STRUCTURAL BODIES

BACKGROUND OF THE INVENTION (1) Field of the Invention

The present invention relates to a method of drying honeycomb structural bodies in which a dielectric drying is performed by moving the honeycomb structural bodies in a dielectric drying apparatus under a condition such that vapor is flowed in the dielectric drying apparatus.

(2) Prior Art Statement

Generally, when the honeycomb structural body formed from a batch containing water component is dried, a dielectric drying utilizing the dielectric drying apparatus is performed. Specifically, a dielectric drying is performed by moving the honeycomb structural body in the dielectric drying apparatus as follows. That is, the honeycomb structural body is set on a carrier in such a manner that one end portion of the honeycomb structural body is contacted to a surface of the carrier, and the carrier is moved under a condition such that vapor is flowed in the dielectric drying apparatus so as to prevent a cutout defect of an outer wall.

The method of drying the honeycomb structural bodies utilizing a known dielectric drying mentioned above is sufficient for drying the known honeycomb structural body with no defects in which a thickness of a rib is relatively thicker or in which a size (outer diameter, length) is small. However, in the case that a thin wall honeycomb structural body having a rib thickness of for example 2 mill or less, that is recently required, is dried, a so-called rib twist defect, in which the rib is not generated straight at the end portion of the honeycomb structural body as shown in FIGS. 2 and 3, occurs frequently. If such a rib twist defect is generated, a strength of the honeycomb structural body is decreased, and it is not possible to obtain normal honeycomb structural bodies. Therefore, it is desired to develop a technique for preventing the rib twist defect.

SUMMARY OF THE INVENTION

An object of the present invention is to eliminate the drawbacks mentioned above and to provide a method of drying honeycomb structural bodies in which defects such as rib twist and so on are not generated during a drying operation even if a thin wall honeycomb structural body is dried.

According to the invention, a method of drying honeycomb structural bodies in which a dielectric drying is performed by moving the honeycomb structural bodies in a dielectric drying apparatus under a condition such that vapor is flowed in the dielectric drying apparatus, comprises the steps of: covering a surrounding area of the honeycomb structural body by a sheet with a constant space; and performing the dielectric drying under such a condition.

In the present invention, since the surrounding area of the honeycomb structural body is covered by the sheet with a constant space during the dielectric drying operation, it is possible to increase humidity around an outer wall of the honeycomb structural body, and a wind flowing in the dielectric drying apparatus is not directly contacted to the outer wall. Therefore, a drying of the outer wall can be slow, and drying speeds at the outer wall and at inner portion of the honeycomb structural body are substantially same. In this manner, a drying balance of the honeycomb structural body can be achieved, and thus it is possible to prevent the defect generation such as rib twist and so on during the drying operation.

As a preferred embodiment of the present invention, there are following features such that: a Teflon® fluorocarbon resin sheet is used as the sheet; a dielectric drying is performed under a condition such that additional electrodes are set directly to both end portions of the honeycomb structural body on the carrier of the dielectric drying apparatus; and the space between the honeycomb structural body and the sheet is set to 20 –30 mm. In all the preferred embodiments mentioned above, it is possible to prevent the rib twist defect more effectively, and thus they are the preferred embodiments.

BRIEF DESCRIPTION OF THE DRAWING

For a better understanding of the present invention, explanations are made to the following drawings wherein.

DESCRIPTION OF THE PREFERRED EMBODIMENTS

Figure 1:
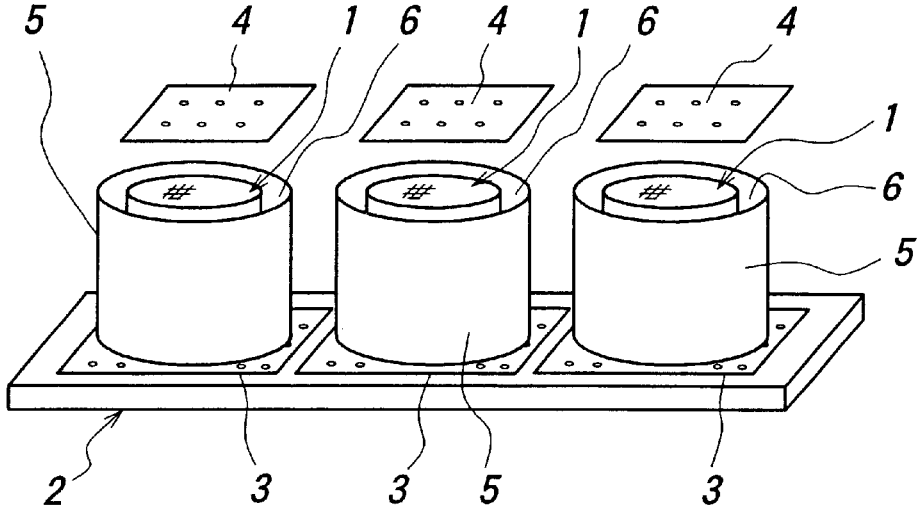
FIG. 1 is a schematic view for explaining one embodiment of a method of drying honeycomb structural bodies according to the invention.
Figure 2:
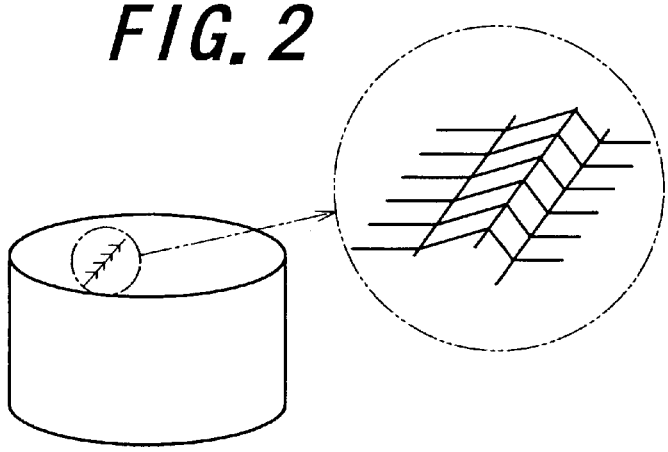
FIG. 2 is a schematic view for explaining one embodiment of a defect in the known method of drying honeycomb structural bodies.
Figure 3:
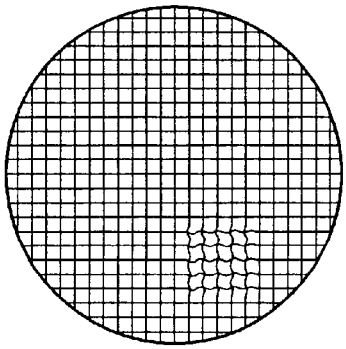
FIG. 3 is a schematic view for explaining another embodiment of a defect in the known method of drying honeycomb structural bodies.

FIG. 1 is a schematic view for explaining one embodiment of a method of drying honeycomb structural bodies according to the invention. In FIG. 1, a state only near honeycomb structural bodies in a dielectric drying apparatus is shown. In the embodiment shown in FIG. 1, a numeral 1 is a honeycomb structural body, and a numeral 2 is a carrier for setting an end portion of the honeycomb structural body 1 thereon, which is constructed so as to be movable in the dielectric drying apparatus. Moreover, in this embodiment, a lower additional electrode 3 is arranged between a lower end surface of the honeycomb structural body 1 and the carrier 2, and an upper additional electrode 4 is arranged on an upper end surface of the honeycomb structural body 1.

The honeycomb structural body 1 to be dried according to the drying method of the invention is obtained by extruding a ceramic batch such as for example cordierite by utilizing a die. Since the batch contains a large amount of water component, a water control of the honeycomb structural body is performed by drying it before sintering so as to be able to sinter the honeycomb structural body. Moreover, in the embodiment shown in FIG. 1, a cross section of the honeycomb structural body 1 is circular shape, but use may be made of the honeycomb structural body 1 having a cross section of race track shape, oval shape and so on. As to the cross sectional shape, since a rib twist defect is easily generated in the honeycomb structural body 1 having cross sections other than circular shape, the present invention can be applied more effectively for such honeycomb structural bodies 1. Further, vapor (not shown) is flowed in the dielectric drying apparatus.

A feature of the method of drying honeycomb structural bodies according to the invention is that a surrounding area of the honeycomb structural body 1 is covered by the sheet 5 with a constant space and the dielectric drying is performed under such a condition. As the sheet 5, since a temperature during the drying operation is about 100° C., use may be made of any sheets even if they have a heat resistance for this temperature. However, it is preferred to use Teflon® fluorocarbon resin. The sheet 5 made of Teflon® fluorocarbon resin has a low dielectric constant and thus it is not easily self-heated. Therefore, it has a sufficient heat resistance for that temperature. Moreover, a reason for using the sheet 5 is that the sheet 5 can be applied flexibly even if the honeycomb structural body has any cross sectional shapes.

The space between the honeycomb structural body 1 and the sheet 5 is not particularly limited since a preferred range is varied in accordance with a size of the honeycomb structural body 1. However, in the honeycomb structural body 1 having a diameter of 100–150 mm that is used normally, it is preferred to set a space 6 to 20–30 mm so as to increase humidity around near the outer wall of the honeycomb structural body 1. Moreover, in the embodiment shown in FIG. 1, the lower additional electrode 3 and the upper additional electrode 4 are arranged to the both end portions of the honeycomb structural body 1, and an efficiency of dielectric drying is increased as compared with the dielectric drying apparatus in which the additional electrodes are not used. However, it is a matter of course that the present invention can be applied effectively to the dielectric drying apparatus in which the additional electrodes 3 and 4 are not used.

In the embodiment shown in FIG. 1, an actual dielectric drying operation can be performed as follows. That is, the honeycomb structural body 1 after forming is firstly set on the lower additional electrode 3 mounted on the carrier 2. Then, a surrounding area of the honeycomb structural body 1 is covered by the sheet 5 with a constant space. In this case, it is preferred to set a height of the sheet 5 equal to or a little lower than that of the honeycomb structural body 1 so as not to be an obstacle for the upper additional electrode 4 when it is set on the upper end portion of the honeycomb structural body 1. Under such a condition, the honeycomb structural body 1 is moved in the dielectric drying apparatus, in which vapor is flowed, by moving the carrier 2. In this manner, the dielectric drying operation can be performed.

In the present invention, the space 6 is formed between the outer wall of the honeycomb structural body 1 and the sheet 5 during the dielectric drying operation, and an atmosphere having a high humidity is maintained in the space 6 in accordance with drying of the honeycomb structural body 1. In this case, it is possible to maintain a humidity of an atmosphere in the space 6 equal to or higher than that of an inner atmosphere of the dielectric drying apparatus. Therefore, a drying speed near the outer wall of the honeycomb structural body 1 can be made slow as compared with the case in which the sheet 5 is not arranged. Moreover, a wind is flowed in the dielectric drying apparatus, but this wind is not directly contacted to the outer wall of the honeycomb structural body 1 since the wind is interrupted by the sheet 5. As a result, it is possible to achieve substantially same drying speeds both at the outer wall and at the inner portion of the honeycomb structural body 1.

As clearly understood from the above explanations, according to the invention, since the surrounding area of the honeycomb structural body is covered by the sheet with a constant space during the dielectric drying operation, it is possible to increase humidity around an outer wall of the honeycomb structural body, and a wind flowing in the dielectric drying apparatus is not directly contacted to the outer wall. Therefore, a drying of the outer wall can be slow, and drying speeds at the outer wall and at inner portion of the honeycomb structural body are substantially same. In this manner, a drying balance of the honeycomb structural body can be achieved, and thus it is possible to prevent the defect generation such as rib twist and so on during the drying operation.

What is claimed is:

1. A method of drying ceramic honeycomb structural bodies in which a dielectric drying is performed by moving the ceramic honeycomb structural bodies in a dielectric drying apparatus under a condition such that vapor is flowed in the dielectric drying apparatus, comprising the steps of: covering a surrounding area of the ceramic honeycomb structural body by a sheet with a constant space; and performing the dielectric drying under such a condition.

2. The method of drying honeycomb structural bodies according to claim 1, wherein a Teflon® fluorocarbon resin sheet is used as the sheet.

3. The method of drying honeycomb structural bodies according to claim 1, wherein the dielectric drying is performed under a condition such that additional electrodes are set directly to both end portions of the honeycomb structural body on a carrier of the dielectric drying apparatus.

4. The method of drying honeycomb structural bodies according to claim 1, wherein the space between the honeycomb structural body and the sheet is set to 20–30 mm.

5. A dried ceramic honeycomb structural body made by the process of claim 1.

6. A dried ceramic honeycomb structural body made by the process of claim 2.

7. A dried ceramic honeycomb structural body made by the process of claim 3.

8. A dried ceramic honeycomb structural body made by the process of claim 4.

* * * * *